US005332050A

United States Patent [19]

Huval

[11] Patent Number: 5,332,050

[45] Date of Patent: Jul. 26, 1994

[54] WELL DRILLING TOOL

[75] Inventor: Ronald J. Huval, Youngsville, La.

[73] Assignee: Tri City Services, Inc., Youngsville, La.

[21] Appl. No.: 85,098

[22] Filed: Jul. 2, 1993

Related U.S. Application Data

[62] Division of Ser. No. 760,178, Sep. 16, 1991.

[51] Int. Cl.[5] ..... E21B 43/00

[52] U.S. Cl. ..... 175/320; 175/374; 175/425

[58] Field of Search ..... 166/402, 90; 175/320, 175/307, 325.1, 374, 425

[56] References Cited

U.S. PATENT DOCUMENTS

| | | | |
|---|---|---|---|
| 4,245,698 | 1/1981 | Berkowitz et al. | 166/244.1 |
| 4,830,889 | 5/1989 | Henry et al. | 427/438 |
| 4,956,238 | 9/1990 | Griffin | 175/374 X |

*Primary Examiner*—William P. Neuder
*Attorney, Agent, or Firm*—Keaty & Keaty

[57] ABSTRACT

The invention relates to improvement in well drilling tools to prevent drilling fluids and solid particles present in a subterranean location from adhering to drilling equipment. A nickel-phosphorus coating is deposited by an electroless plating process on the entire surface of the tool, so as to substantially reduce porosity of the tool and prevent penetration of the foreign matter into the ferrous core of the tool.

5 Claims, No Drawings

WELL DRILLING TOOL

This is a division of application Ser. No. 760,178, filed Sep. 16, 1991.

BACKGROUND OF THE INVENTION

The present invention relates to well drilling equipment, and more particularly to a tool adapted for use in a subterranean location, where it becomes exposed to drilling fluids and solid particles present in that location.

At the present time a major part of well drilling tools, such as stabilizers, drilling bits, and the like are constructed from steel, having a grade of 4140 or 4141.

While such steel appears to be appropriate for well drilling operations, it has a definite disadvantage in that it tends to absorb, through its micro-pores, drilling fluids and solid particles which in the industry are generally referred to as "Gumbo". Once this gumbo penetrates into the pores, it becomes extremely difficult to remove it by any conventional means, especially if the stabilizer and the drilling bit are in a subterranean location.

Such accumulation of deposit on the drilling tool often causes a jam above and below the stabilizer and sometime requires many days of circulation of cleaning compositions through the drilling string, so as to get rid of the deposits at least on the annular walls surrounding the well, so as to retrieve the drilling tool and either replace it or attempt to clean it.

It is apparent that such interruption of a drilling process causes a considerable financial loss which will continue to mount while the well is cleaned to retrieve the drilling equipment.

A number of manufacturers attempted to solve the problem of gumbo penetration into the pores of a ferrous core, one of the solutions being the use of Monel equipment on the core, so as to fill the pores and prevent accumulation of the foreign matter on the drilling equipment. However, the cost of any equipment considerably rises with the use of Monel or stainless steel.

It is therefore the main object of the present invention to provide an improved tool and process for treating a surface of the tool to prevent "Gumbo" accumulation on the drilling tool.

SUMMARY OF THE INVENTION

The present invention contemplates provision of an improved tool and a process for treating a tool surface, so as to prevent accumulation of drilling fluid and solid particles on the tool.

It is an object of the present invention to provide a tool possessing the above properties.

It is a further object of the present invention to provide a tool and a process which is relatively inexpensive, so as to allow even larger size tools to be treated.

It is a further object of the present invention to provide a method of treating a surface of the tool to prevent adherence of the drilling fluids and solid particles present in a subterranean location to the ferrous core.

The present invention solves the problems associated with the prior art well drilling tools and achieves its object in a simple and straightforward manner.

A tool having a ferrous core is submerged in an aqueous acid nickel-phosphorus bath, so as to cause autocatalytic nickel plating to depose a nickel alloy coating on the surface of the tool and fill the pores of the tool, thus forming a substantially pore-free, smooth exterior. In some cases, when the costs of treating the surface are justified by the improved performance of the tool, TEFLON® can be co-deposited with electroless nickel to provide an improved coating having even less adherence properties than those achieved by a conventional nickel-phosphorous alloy deposit.

DETAIL DESCRIPTION OF THE PREFERRED EMBODIMENT

A well drilling tool, for example an oil well stabilizer or a drilling bit is submerged in ah aqueous acid nickel-phosphorus bath. A reducing agent, chelate, complexing agent and a stabilizer is added to the bath to cause a chemical reaction on the surface of the tool and create a deposit of a nickel alloy through electroless nickel plating which continues until such time as a coating of from approximately 0.001 to about 0.005 mm is deposited on the entire exterior surface of the tool.

The coating is generally uniform in thickness, coats various curves and internal surfaces of the tool. The resulting coating is a dense alloy of nickel and phosphorus, wherein the amount of phosphorus can vary from 7%–12% depending upon bath formulation, operating PH and bath age.

Since the deposition process is autocatalytic, the primary layer and subsequent layer will continue to build up until the desired thickness is achieved.

Generally, sodium hypophosphite is used as a reducing agent, although other reducing agents can be used if desired.

A resultant deposit contains from about 88% to 93% nickel and from about 7% to about 12% phosphorus.

It is recommended that the tool prior to being submerged into the plating bath be soaked clean, rinsed, then cleaned with the assistance of electrical current, such as with the use of anodes and rinsed again.

The tool is then dipped into a 10% concentrated sulfuric acid and rinsed again. A cleaning process with assistance electrical current with a subsequent rinsing follows the acid dipping and rinsing. Finally, the tool can be submerged into the plating bath to allow the nickel-phosphorus deposit to be formed. Under certain circumstances, it is recommended that the tool having a nickel-phosphorus coating be heat treated to further enhance strength of the just deposited coating. It is conventional to expose the improved tool to temperatures between 200 degrees Fahrenheit to about 750 degrees Fahrenheit. A slow gradual cooling of the heated tool follows the heat treatment.

The resultant coating is very smooth, has considerably less porocity count than the ferrous core and is suitable for use in subterranean drilling operations without the fear of the fluid particles and drilling fluids being adhered to the tool itself.

Many changes and modifications can be made within the present invention without departing from the spirit thereof. I, therefore, pray that my rights to the present invention be limited only by the scope of the appended claims.

I claim:

1. A well drilling tool, comprising:

a ferrous core and a coating for preventing adherence of well drilling fluids and fluid particles in subterranean locations, said coating forming a substantially uniform nickel-phosphorus layer which comprises from about 7% to about 12% phosphorus and from about 88% to about 93% nickel deposited by electroless plating.

2. The tool of claim 1, wherein the coating is from about 0.001 mm to 0.005 mm in uniform thickness.

3. An improved tool for drilling a subterranean well having a ferrous core, wherein the improvement comprises a coating means deposited on the core for preventing drilling fluids and solid particles of subterranean strata from adhering to the tool core, the coating comprising a layer of nickel and phosphorus containing deposit, said deposit being formed by electroless plating and having from about 0.001 millimeter to abut 0.005 millimeter thickness.

4. The tool of claim 3, wherein the coating comprises from about 7% to about 12% of phosphorus and from about 88% to about 93% of nickel.

5. In a well drilling tool having a ferrous core and a means for preventing drilling fluids and solid particles from adhering to the core in a subterranean location, the means for preventing adherence comprising a nickel and phosphorus containing coating deposited on the core by electroless plating.

* * * * *